United States Patent [19]

Matsumoto et al.

[11] 4,421,430

[45] Dec. 20, 1983

[54] DOT PRINTER

[75] Inventors: Yoshikane Matsumoto; Tsuneki Kobayashi; Makoto Kurosawa; Minoru Seino, all of Katsuta, Japan

[73] Assignee: Hitachi Koki Company, Limited, Tokyo, Japan

[21] Appl. No.: 367,518

[22] Filed: Apr. 12, 1982

[30] Foreign Application Priority Data

Apr. 13, 1981 [JP] Japan ..... 56-55796

[51] Int. Cl.[3] ..... B41J 3/10

[52] U.S. Cl. ..... 400/121; 101/93.04; 101/93.09; 400/320; 400/352

[58] Field of Search ..... 400/121, 124, 320, 352; 101/93.04, 93.05, 93.09

[56] References Cited

U.S. PATENT DOCUMENTS

| | | | |
|---|---|---|---|
| 3,941,051 | 3/1976 | Barrus et al. | 101/93.04 |
| 4,218,149 | 8/1980 | Okada | 101/93.05 X |
| 4,278,019 | 7/1981 | Meier | 101/93.09 X |
| 4,306,497 | 12/1981 | Hamada | 101/93.05 |

FOREIGN PATENT DOCUMENTS

| | | | |
|---|---|---|---|
| 56-154063 | 11/1981 | Japan | 101/93.05 |

*Primary Examiner*—Paul T. Sewell

*Attorney, Agent, or Firm*—Sughrue, Mion, Zinn, Macpeak and Seas

[57] ABSTRACT

A printing mechanism is provided with a counterbalanced hammer bank such that the hammer bank and a counterweight are oppositely reciprocated by a pair of coaxial, identical, orthogonally oriented cams. Vibration of the printer even at high speed can be eliminated by completely dynamically balancing the system.

5 Claims, 6 Drawing Figures

DOT PRINTER

BACKGROUND OF THE INVENTION

This invention relates to dot printers in which dot printing is carried out using printing hammers, for example those disclosed in U.S. Pat. No. 3,941,051 or printing wires, for example as disclosed in U.S. Pat. No. 3,999,644, and more particularly to a mechanism which reciprocates a hammer bank incorporating such printing hammers or printing wires and drive means therefor along a printing line.

In the case of a printer in which the printing hammers or wires are driven while such a hammer bank is reciprocated along a printing line, the weight of the hammer bank is considerably large and the speed of movement of the hammer bank is high. Accordingly, the printer itself is greatly vibrated. In order to decrease printer vibration, a method has been employed in which the hammer bank and a counterweight having a weight equal to the weight of the hammer bank are reciprocated in opposite directions.

The hammer bank and the counterweight are provided on both sides of an elliptic cam. The hammer bank and the counterweight are each moved by the cam in one direction and by a spring in the opposite direction. Accordingly, the drive source such as an electric motor must have a large capacity, because it must move both the hammer bank and the counterweight against the elastic force of the springs. This tendency is increased as the speed of the hammer bank, i.e., the speed of rotation of the cam, is increased to increase the printing speed. If a large capacity drive motor of large size is employed as the drive source, problems as to installation space and cooling means arise, and it becomes impossible to miniaturize the printer.

SUMMARY OF THE INVENTION

An object of this invention is to eliminate the abovedescribed difficulties accompanying conventional dot printers, to make it possible for a small capacity motor to reciprocate the hammer bank and the counterweight, and to provide a high printing speed without increasing the size of the dot printer.

This invention has been developed from the fact that, if the hammer bank and the counterweight are driven by a pair of substantially elliptic cams whose major diameters are substantially orthogonal with one another, then the hammer bank and the counterweight can be reciprocated without using springs. The cams, sliders reciprocated by the cams and the hammer bank and the counterweight which are coupled to the sliders are skillfully combined according to the invention.

BRIEF DESCRIPTION OF THE DRAWINGS

In FIG. 2, a lower slider is shown displaced from its actual position, as conductive to an understanding of the invention;

DETAILED DESCRIPTION OF THE PREFERRED EMBODIMENTS

Figure 1:
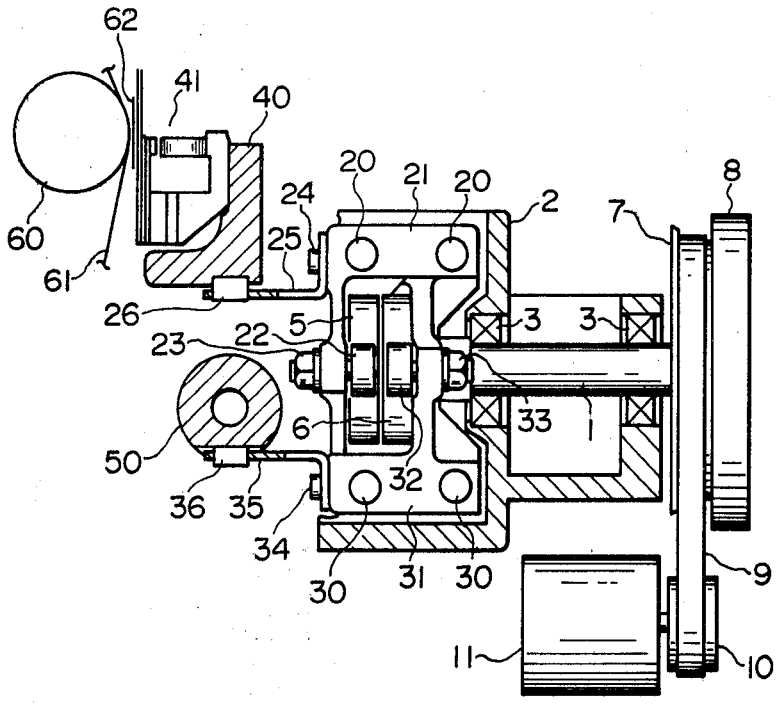
FIG. 1 is a cross-sectional view showing the essential components of a first embodiment of the invention.
Figure 2:
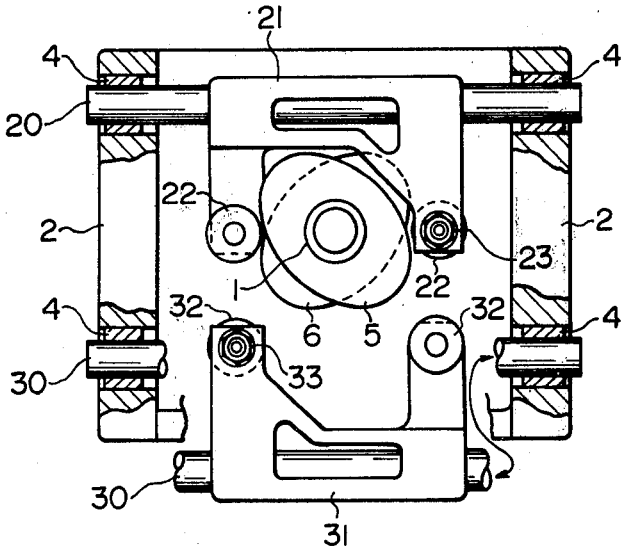
FIG. 2 is a side view of the device as viewed from the side of the hammer bank in FIG. 1.

Referring to FIGS. 1 and 2, a cam shaft 1 is rotatably supported on a frame 2 with the aid of bearings 3, and is driven through a driven pulley 7, a belt 9 and a drive pulley 10 by a motor 11. A fly wheel 8 is coupled to the rear end of the cam shaft 1, so as to minimize variations in rotation of the cam shaft 1. A pair of cams 5 and 6 are mounted on the front end portion of the cam shaft 1 in such a manner that the major diameters thereof are substantially orthogonal to one another.

Substantially C-shaped sliders 21 and 31 are mounted respectively on two guide shafts 20 and 30 which are supported through linear slide bearings 4 on the frame 2, and are provided respectively above and below the cam shaft 1, so that the sliders 21 and 31 can be reciprocated perpendicularly to the cam shaft 1. Each of the sliders 21 and 31 has two arms which extend on either side of the cam shaft 1 and perpendicularly to the cam shaft 1. Rollers 22 are rotatably mounted on the ends of the two arms of the slider 21 with nuts 23, respectively. Similarly, rollers 32 are rotatably mounted on the ends of the two arms of the slider 31 by nuts 33. The arms of the upper slider 21 extend downwardly so that the pair of rollers 22 are in contact with the rear cam surface of the first cam 5 and the front cam surface of the second cam 6, respectively. On the other hand, the arms of the lower slider 31 extend upwardly so that the pair of rollers 32 are respectively in contact with the front cam surface of the first cam 5 and the rear cam surface of the second cam 6.

L-shaped holders 25 and 35 are secured to the front surfaces of the sliders 21 and 31 with bolts 24 and 34, respectively. The holders 25 and 35 have arms extending forwardly on which a hammer bank 40 and a counterweight 50 are mounted through blocks 26 and 36, respectively. The hammer bank 40 has a plurality of printing hammers arranged in a printing line, and drive means for driving the printing hammers, the hammers and drive means being generally indicated at 41. The drive means are made up of permanent magnets, yokes, and releasing coils, etc; however, the illustration and detailed description thereof is not believed necessary. The drive means may be that disclosed in detail in U.S. Pat. No. 3,941,051. The weight of the counterweight 50 is selected so that it is substantially equal to the total weight of the hammer bank 40, including the printing hammers and the drive means which are generally indicated at 41.

A platen 60 is provided along the printing line so that it confronts the printing hammers through a printing sheet 61 and an ink ribbon 62.

The rollers 22 and 32 are in contact with the cam surfaces of the cams 5 and 6 as described above. Therefore, as the cam shaft 1 rotates, the sliders 21 and 31 are reciprocated in opposite directions and horizontally in FIG. 2, and accordingly the hammer bank 40 and the counterweight 50 are also reciprocated in opposite directions and perpendicularly to the surface of the drawing in FIG. 1. In this operation, the hammer bank 40 and the counterweight 50 are dynamically in balance with one another, because they are equal in both weight and acceleration. Thus, the printer will not vibrate.

In the above-described embodiment, the rollers 22 and 32 are made rotatable in order to minimize the wear of the rollers 22 and 32 and the contacting cam surfaces of the cams 5 and 6, and to thereby reduce the drive torque of the motor 11. However, in a case where it is unnecessary to take wear into account, the rollers 22 and 32 may be fixed elements.

As is apparent from the above description, according to the invention, the hammer bank and the counterweight are reciprocated by two cams, and returning springs are not necessary. Therefore, the arrangement around the cam is considerably simple, and the printer can be minimized. Furthermore, the motor 11 may be of small capacity, which contributes to the miniaturization of the printer. Thus, a high speed printer can be readily provided. As the configuration of the cams can be selected as desired, the hammer bank and the counterweight can be reciprocated with any desired speed characteristic.

Figure 3:
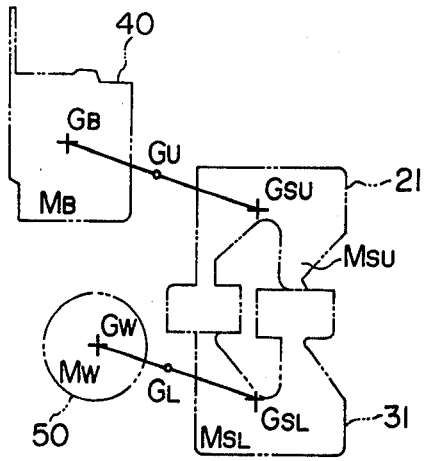
FIG. 3 is a front view of the first embodiment, illustrating the arrangement of the weights of the reciprocating members of FIG. 1.
Figure 4:
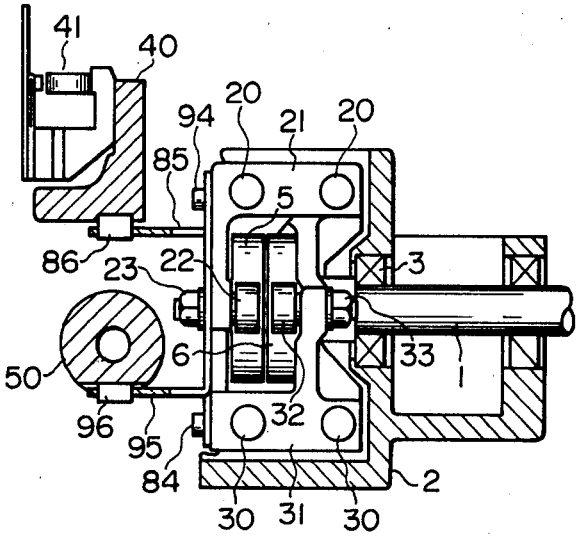
FIG. 4 is a cross-sectional view of the essential components of a second embodiment of the invention.

FIG. 4 shows another embodiment of the invention. Before discussing the embodiment shown in FIG. 4, a problem involved in the first embodiment will be described with reference to FIG. 3.

As was described above, the hammer bank 40 and the counterweight 50 carry out reciprocations which are different by 180° in phase, so that the reaction forces caused by the accelerations are cancelled out, to thereby prevent the vibration of the printer. However, the reaction forces cancelled out are only those in the direction of acceleration of the hammer bank 40 and the counterweight 50, and a couple due to the reaction forces described below cannot be cancelled out in the first embodiment.

FIG. 3 is an explanatory diagram which simply shows the arrangement of the weights or masses of the reciprocating members in FIG. 1. In FIG. 3, reference characters $G_B$ and $M_B$ designate the center of gravity and the weight of the hammer bank 40 including the printing hammers and the drive means (41), respectively; $G_W$ and $M_W$, the center of gravity and the weight of the counterweight 50, respectively; $G_{SU}$ and $M_{SU}$, the center of gravity and the weight of the slider 21, respectively; and $G_{SL}$ and $M_{SL}$, the center of gravity and the weight of the slider 31. Because of the counter balance mechanism, $(M_B+M_{SU})=(M_W+M_{SL})$.

Further in FIG. 3, reference character $G_U$ designates the center of gravity of an assembly including the hammer bank 40, the slider 21 and the holder 25; and $G_L$, the center of gravity of an assembly including the counterweight 50, the slider 31 and the holder 35. As is apparent from FIG. 3, the center of gravity $G_U$ is spaced from the center of gravity $G_L$. As the hammer bank 40 and the counterweight 50 are accelerated in opposite directions and perpendicularly to the surface of the drawing as was described before, a couple M is formed which may be represented by the following expression:

$$M=\alpha(M_B+M_{SU})\cdot\overline{G_UG_L}$$

where $\alpha$ is the acceleration of the hammer bank 40 and the counterweight 50.

The printer is additionally vibrated by the couple M in association with the reciprocation period of the hammer bank 40. The acceleration $\alpha$ is proportional to the square of the reciprocation speed. Therefore, in the case of a relatively low speed printer, by reducing the weight of the reciprocating members and making the distance $\overline{G_UG_L}$ between the gravity centers as short as possible the couple M can be decreased, so that the vibration is decreased. On the other hand, in the case of a high speed printer, it is substantially impossible to suitably decrease the couple M by merely reducing the distance between the gravity centers, because the speed of reciprocation of the hammer bank 40 is high and accordingly the acceleration is large.

In view of the foregoing, the embodiment shown in FIG. 4 is so designed that the couple M is made substantially equal to zero. In this embodiment, a hammer bank 40 is mounted through a block 86 on a holder 85 which is secured to a lower slider 31 with bolts 84; and a counterweight 50 is mounted through a block 96 on a holder 95 which is secured to an upper slider 21 with bolts 94.

Figure 5:
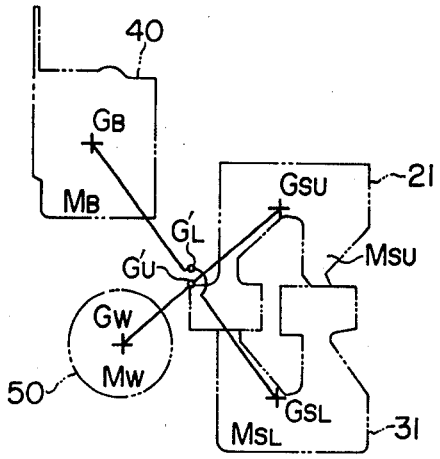
FIG. 5 is a front view of the second embodiment, illustrating the arrangement of the weights of the reciprocating members of FIG. 4; and, FIG. 6 is a cross-sectional view showing another embodiment of the invention.
Figure 6:
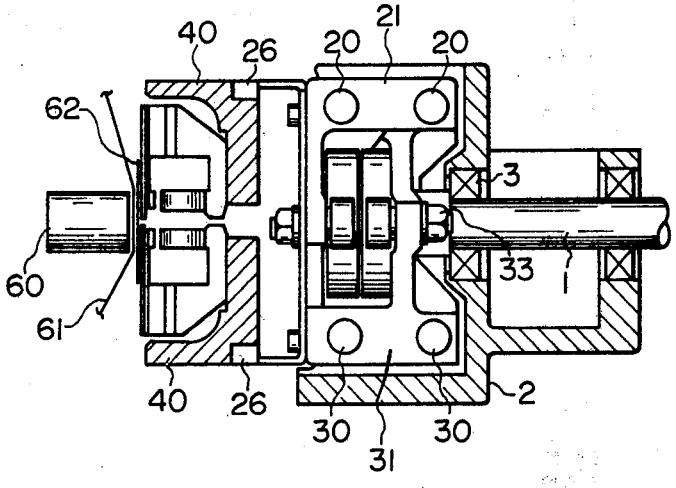

FIG. 5 is an explanatory diagram which simply shows the arrangement of the weights of the reciprocating members in the second embodiment shown in FIG. 4. A line connecting the center of gravity $G_B$ of the hammer bank 40 to the center of gravity $G_{SL}$ of the slider 31 and a line connecting the center of gravity $G_W$ of the counterweight 50 to the center of gravity $G_{SU}$ of the slider 21 cross each other substantially at the mid points thereof in a vertical plane. Accordingly, as is apparent from FIG. 5, the center of gravity $G_L'$ of an assembly including the hammer bank 40, the slider 31 and the holder 85 is very close to the center of gravity $G_U'$ of an assembly including the counterweight 50, the slider 21 and the holder 95, and the distance $\overline{G_UG_L}$ between the gravity centers is substantially zeroed, so that the value of the couple M is substantially equal to zero.

That is, in the arrangement in FIG. 4, not only can the reaction forces in the direction of acceleration be cancelled out, but also the couple due to the reaction forces can be eliminated. Since this is effected even when the speed of reciprocation of the hammer bank is increased, the printer can be stably operated at any speed.

In either of the above-described embodiments, the counter balance is obtained by accelerating the counterweight 50 in a direction opposite to the direction of acceleration of the hammer bank 40. However, the counter balance may be obtained as follows. For instance, as disclosed by U.S. patent application Ser. No. 291,719, two hammer banks which are accelerated to reciprocate in opposite directions may be arranged perpendicular to the printing line with a predetermined distance therebetween. One of the hammer banks is driven as the above-described counterweight 50. This method is advantageous in that the printing speed can be increased since two hammer banks are employed.

What is claimed is:

1. A dot printer, comprising:

a rotatable cam shaft, and means for driving said cam shaft;

a pair of cams mounted on said cam shaft in a manner such that the major diameters thereof are orthogonal with one another;

a pair of first and second sliders reciprocable in opposite directions and perpendicularly to said cam shaft, said sliders being in contact with cam surfaces of said pair of cams and on both sides of said cam shaft;

hammer bank means including a plurality of printing hammers, and a hammer bank coupled to said first slider so that said hammer bank is reciprocated along a printing line; and a counterweight coupled to said second slider so that said counterweight is reciprocated in a direction opposite the direction of reciprocation of said hammer bank, said counterweight having a weight which is substantially equal to that of said hammer bank; and said hammer bank and said counterweight being coupled to said pair of sliders in a manner such that a line connecting the center of gravity of said hammer bank to the center of gravity of one of said pair of sliders and a line connecting the center of gravity of said counterweight to the center of gravity of the other slider cross another.

2. A dot printer as claimed in claim 1, said first and second sliders including rollers for contacting said cam surfaces, each said slider including a pair of said rollers.

3. A dot printer as claimed in claim 1, said hammer bank means comprising two hammer banks, including a plurality of printing hammers and drive means for driving the printing hammers, one of said two hammer banks being employed as said counterweight, wherein in each of said two hammer banks, the printing positions of the printing hammers are spaced by a predetermined distance perpendicularly to the printing line.

4. A dot printer as claimed in claim 1, said hammer bank including drive means for driving said printing hammers.

5. A dot printer as claimed in claim 1, said hammer bank and said counterweight being respectively connected to said one of said pair of sliders and said other slider.

* * * * *